United States Patent [19]

Hepworth

[11] 4,063,356

[45] Dec. 20, 1977

[54] HAND KNIFE

[75] Inventor: Paul Steabben Hepworth, Leicester, England

[73] Assignee: Plas Plugs Limited, Burton-on-Trent, England

[21] Appl. No.: 717,015

[22] Filed: Aug. 23, 1976

[30] Foreign Application Priority Data

Sept. 10, 1975 United Kingdom ..... 37201/75

[51] Int. Cl.[2] ..... B26B 1/00

[52] U.S. Cl. ..... 30/162; 30/320; 30/335

[58] Field of Search ..... 30/162, 320, 335

[56] References Cited

U.S. PATENT DOCUMENTS

| | | | |
|---|---|---|---|
| 1,434,388 | 11/1922 | Hughes | 30/162 X |
| 1,622,870 | 3/1927 | Hulse | 30/320 |
| 2,145,985 | 2/1939 | Krajicek | 30/162 X |
| 3,063,147 | 11/1962 | Paparelli | 30/320 X |
| 3,192,624 | 7/1965 | Gringer | 30/162 |
| 3,316,635 | 5/1967 | Merrow et al. | 30/162 |
| 3,453,729 | 7/1969 | Larson | 30/162 |
| 3,855,700 | 12/1974 | Gerson et al. | 30/162 |

FOREIGN PATENT DOCUMENTS

| | | | |
|---|---|---|---|
| 2,440,849 | 3/1975 | Germany | 30/320 |

*Primary Examiner*—Gary L. Smith
*Assistant Examiner*—J. T. Zatarga
*Attorney, Agent, or Firm*—Larson, Taylor and Hinds

[57] ABSTRACT

The invention relates to hand knives of the type comprising a hand grip which houses a strip steel blade with snap-off ends, which when worn can be removed to reveal a fresh operative blade tip. The hand grip comprises an elongated body with a longitudinal slot along which a blade-shifting element of stiffly flexible construction may be moved between a variety of adjustable positions.

4 Claims, 5 Drawing Figures

HAND KNIFE

BACKGROUND OF THE INVENTION

This invention relates to hand knives of the kind comprising a hand grip housing a blade of steel strip which can be projected from the hand grip for use and retracted into this grip and out of the way when not in use.

Provision is made in known knives of this type for adjusting the position of the blade relatively to the hand grip to vary the amount of projection of the tip of the blade from the leading end of the grip but this has involved the dismantling and opening up of the hand grip in something of a laborious operation to allow the blade to be re-set.

BRIEF SUMMARY OF THE INVENTION

It is a first object of the present invention to furnish an arrangement in which the amount of projection of the blade can be adjusted by the hand of the user in a simple operation without any dismantling of the hand grip. A second object is to provide in very simple fashion for adjustment of the length of projecting blade to a range of tip sizes.

Forms of blade strip are known typified by parallel lines of weakening which can be broken along these lines by a tool to enable a worn, operative end of a blade to be discarded in favour of a fresh end. This invention further sets out to present a hand grip construction which incorporates a detachable tool for this purpose.

Thus the present invention provides, for a hand knife having renewable blade portions, a hand grip in the form of an elongated body defining therein a longitudinal passageway for the strip blade, having a longitudinal slot in communication with at least a portion of the length of said passageway which receives and permits the movement along the grip of a blade shifting element, and a set of fixed detent formations in said body co-operating with complementary formations on said knife-shifting element to engage and locate the shifting element in a selected adjusted position.

The required disengagement and re-engagement of the interlocking formations on the hand grip body and the shifting element is, in a preferred embodiment of the invention, implemented by making this element of a stiffly flexible plastics material which is sufficiently rigid to cater for the required interlocking in adjusted status but will yield under finger pressure to deform and release the interlocking engagement. In this arrangement the formations referred to may be interengaging parallel serrations or teeth on the shifting element and/or the body.

To cater for quick insertion of a fresh blade strip into the hand grip without need to dismantle the latter entirely, in accordance with a further feature of the invention the trailing end portion of the hand grip body is made as a quickly-removable push-in fit providing access to the open rear end of the blade-receiving passageway for the insertion of a blade. As a further adjunct, this removable body end portion is furnished with a slit which, when the end portion is removed from the remainder of the body, can be used to receive, engage and, when the end portion is twisted, break off the leading end of a second blade strip in the grip body to remove a worn or damaged section from the latter and present a fresh unworn leading end section of blade.

BRIEF DESCRIPTION OF DRAWINGS

In further elaboration of the invention we describe below two embodiments of a hand knife constructed according to the invention. This description, which is to be read with reference to the accompanying drawings, is given by way of example only and not by way of limitation.

In the drawings.

DETAILED DESCRIPTION OF DRAWINGS

Figure 1:
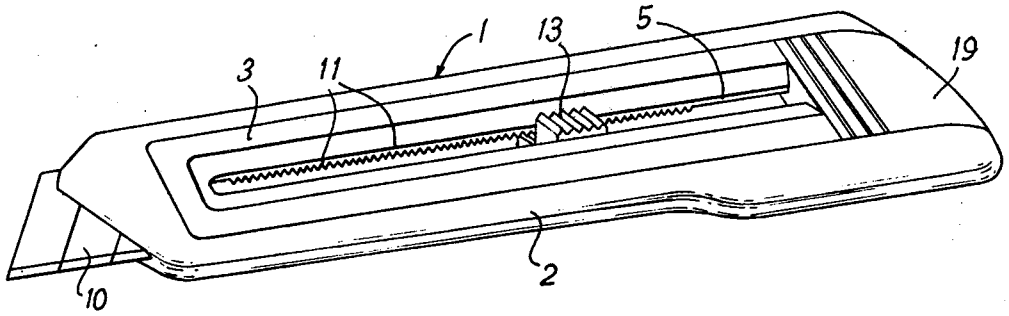
FIG. 1 is a perspective illustration of the first embodiment of a knife according to the invention.
Figure 2:
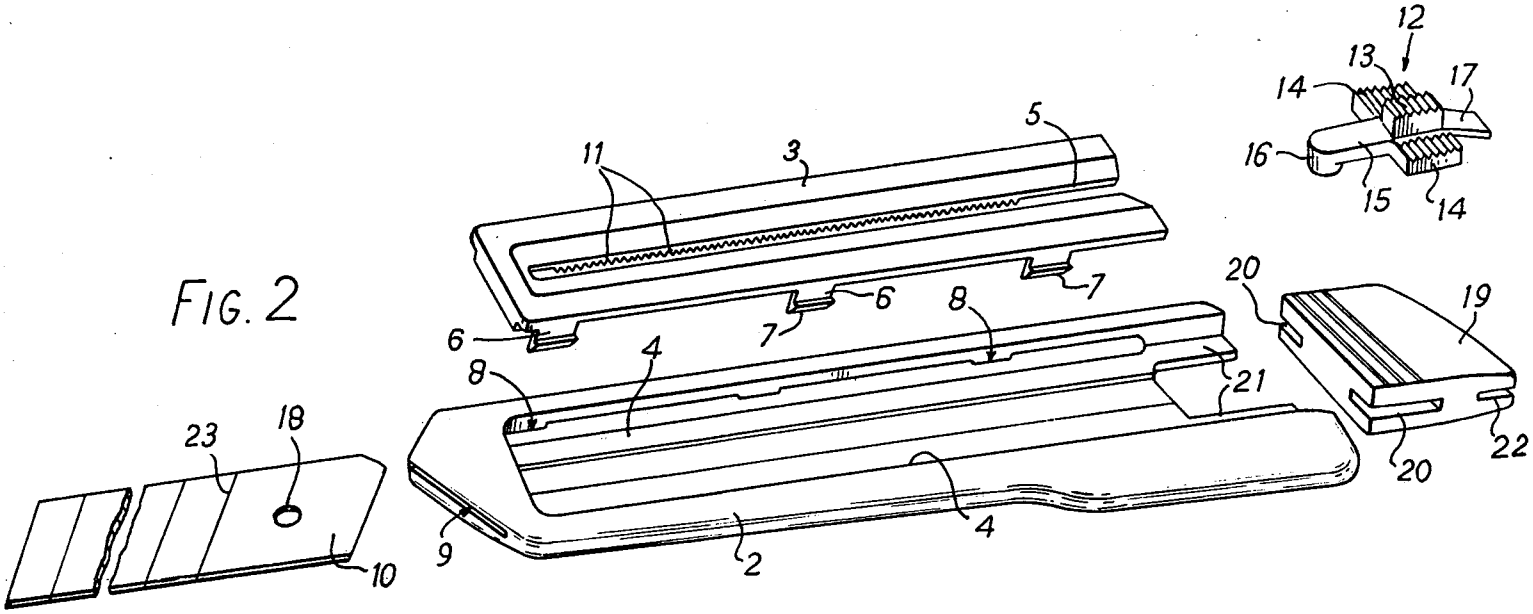
FIG. 2 is an exploded view showing in perspective the component parts of this first embodiment.
Figure 3:
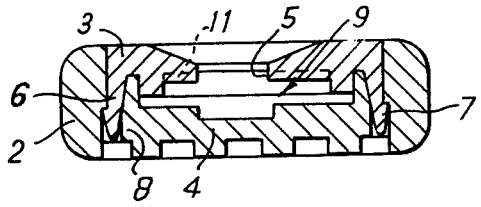
FIG. 3 is a cross section through the assembled knife of FIG. 1.

Referring first to FIGS. 1 to 3 the hand grip of the knife there illustrated is generally designated 1. The body of this grip is made up of two major portions, a base portion 2 forming the larger part of the blade housing, and a complementary cover portion 3 which fits into a dished recess 4 in the base portion 2. The cover portion 3 is provided along the major part of its length with a slot 5 which is open at the right hand end as viewed in the FIGS. The cover 3 is also provided along each side edge with depending lugs 6 which are outturned at their lower ends to form teeth 7. The base portion 2 is provided at intervals along the sides of recess 4 with openings 8 to receive the lugs 6 when the cover portion 3 is pushed into recess 4. The teeth then engage with the base (see FIG. 3) to provide a firm attachment between the cover and base portions.

FIG. 3 shows the assembled body 1 and the manner in which the lugs 6 and their teeth 7 are received in the openings 8 and grip corresponding undercuts in the cover 3. FIG. 3 also slows the slot 5 in the cover portion 3 and a passageway 9 between the cover portion 3 and base portion 4 for receiving a strip-form knife blade 10.

It will also be observed that the portion 2 is provided alongside the major part of the length of the slot 5 with flanking splines or serrations 11 which extend transversely to the longitudinal axis of the body 1. These splines are provided for co-operation with a blade-shifting element 12 which is shown at the right hand side of FIG. 2. This element consists of a press stud or serrated head 13 with two side wings 14, also serrated, a nose 15 with a stud 16 at its leading end and tail 17. When the article is assembled the element 12 is received between the cover 3 and the base 2 with the head 13 projecting through the slot 5 and the wings 14 engaging the splines 11. At the same time the stud 16 is engaged in a hole 18 at the rear end of the knife blade 10.

The various elements so far described, with the exception of blade 10 which is of steel, are moulded from a plastics material, for example polypropylene, which, at any rate in the case of the element 12, is sufficiently resilient to be deformable under normal finger pressure. Thus, with the parts assembled in the condition shown in FIG. 1, the serrations 14 on element 12 are in locking engagement with the splines 11 to hold the element 12 in position within the body 1 with sufficient firmness to resist any shifting when pressure is applied thereto by a cutting action performed with the operative tip of blade 10. On the other hand, the material of element 12 is sufficiently yieldable by the application of finger pressure to the head 13 to flex and allow detachment of wings 14 from the splines 11 to enable the blade to be moved by applying a forwardly or rearwardly directed pressure to element 12. It will therefore be observed that the tip of blade 10 can be projected to a greater or lesser degree from the leading end of body 1 by simple finger action on element 12, and automatically relocked in adjusted position.

Referring in particular to FIG. 1, it will be noted that the right hand end of slot 5 as viewed in that FIG. is closable, when the knife is assembled ready for use, by a detachable end component 19. This end component 19 is provided at one end with slots 20 for engagement with rebated flanges 21 at the rear end of base 2, and is thus a simple push-in fit on this base.

At this opposite end the component 19 is provided with a transverse slit 22 which enables it to function as a blade-breaking tool. It will be observed that the blade illustrated in FIGS. 1 and 2 is provided with parallel lines of scoring 23 transverse to its length. These represent zones of weakness which can be broken to remove a worn tip of the blade and expose a fresh tip as and when required. The component 19 can be used as a breaking tool for this purpose. The blade is projected an appropriate distance from the body 1, the component 19 removed from body 1 and held between the thumb and forefinger, the leading end of the blade inserted in the slot 22 and the component 19 is then twisted to break off the leading end of the blade.

Figure 4:
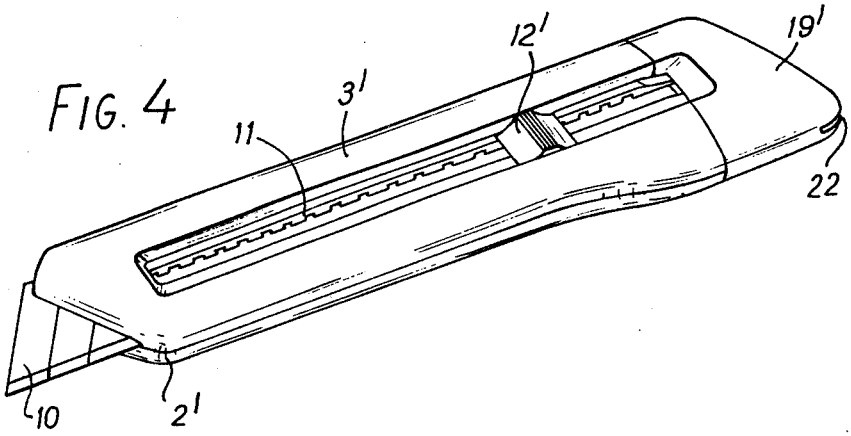
FIG. 4 is a view similar to FIG. 1 but showing a second embodiment.
Figure 5:
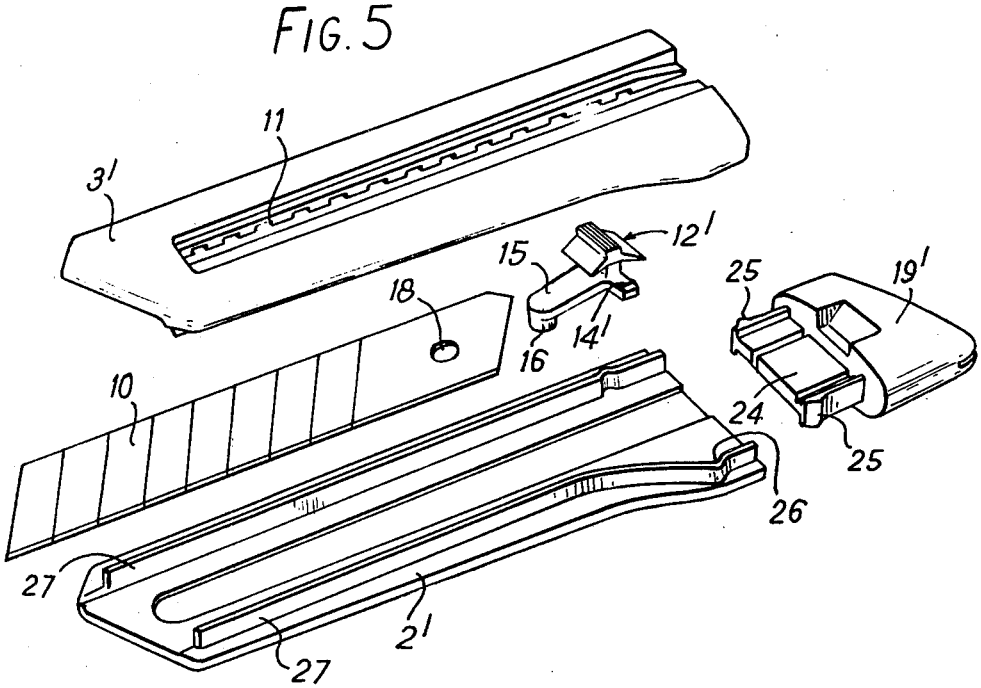
FIG. 5 is an exploded view showing the components of the knife of FIG. 4.

A modified embodiment of the invention is illustrated in FIGS. 4 and 5. The components of this form of knife have been identified with the same references as have been used in connection with FIGS. 1 to 3, where these parts are identical or similar. However it will be noted that a somewhat modified form of end component 19 is here used. This is provided with a stub 24 having projections 25 which engage resiliently with corresponding recesses 26 in the body of base portion 2'. It will also be observed that this base is of modified formation in relation to the base portion 2 of FIGS. 1 to 3 and that the cover portion 3' in this construction is engaged over ribs 27 moulded on the base portion 2' and having recesses 26.

In this construction use is once again made of splines 11 in the cover portion 3' and a shifting element 12' is used which is modified slightly in relation to the corresponding element 12 of FIGS. 1 to 3.

I claim:

1. A hand knife suitable to house a strip steel blade with snap-off ends comprising an elongated body defining therein a longitudinal passageway for the blade, and having a longitudinal slot in communication with at least a portion of the length of said passageway, a blade shifting element, said longitudinal passageway receiving and permitting movement of said blade shifting element, a set of fixed detent formations in said body co-operating with complementary formations on said knife-shifting element to engage and locate the shifting element in a selected adjusted position, and said body being provided with a removable end portion, said end portion having a slot into which a worn portion of the blade may be received and snapped off when the end portion is removed for use.

2. A hand grip as claimed in claim 1, wherein the body comprises two interengaged portions, one forming a base portion and the other a closure portion for the passageway, the slot being formed in the cover portion and being flanked by splines or serrations comprising said detent formations.

3. A hand grip as claimed in claim 2, wherein the bladeshifting element is of stiffly flexible plastics material and comprises a head portion adapted to receive finger pressure to flex the element, and two wing portions bearing serrations, which engage with the detent formations on the cover portion when the element is unflexed.

4. A hand grip as claimed in claim 1, wherein the bladeshifting element is provided with a projection or stud engageable with an aperture in the blade.

* * * * *